US010717173B1

(12) United States Patent
Goldman

(10) Patent No.: US 10,717,173 B1
(45) Date of Patent: Jul. 21, 2020

(54) MODULAR ASSEMBLY JIG SYSTEM

(71) Applicant: Gary B. Goldman, North Miami Beach, FL (US)

(72) Inventor: Gary B. Goldman, North Miami Beach, FL (US)

( * ) Notice: Subject to any disclaimer, the term of this patent is extended or adjusted under 35 U.S.C. 154(b) by 0 days.

(21) Appl. No.: 16/658,095

(22) Filed: Oct. 20, 2019

Related U.S. Application Data

(63) Continuation-in-part of application No. 15/587,541, filed on May 5, 2017, now Pat. No. 10,500,700.

(51) Int. Cl.

| | |
|---|---|
| ***B25B 11/02*** | (2006.01) |
| ***E04G 21/16*** | (2006.01) |
| ***E04G 21/26*** | (2006.01) |
| ***E04G 21/18*** | (2006.01) |
| ***E04B 2/56*** | (2006.01) |
| ***E04F 21/00*** | (2006.01) |

(52) U.S. Cl.
CPC ..... *B25B 11/02* (2013.01); *E04B 2/56* (2013.01); *E04F 21/0015* (2013.01); *E04G 21/165* (2013.01); *E04G 21/18* (2013.01); *E04G 21/1841* (2013.01); *E04G 21/1891* (2013.01); *E04G 21/26* (2013.01)

(58) Field of Classification Search
CPC .. E04F 21/1855; E04F 21/0015; E04G 21/18; E04G 21/1841; E04G 21/1891; E04G 21/26; B25B 11/02; E04B 2/56
See application file for complete search history.

(56) References Cited

U.S. PATENT DOCUMENTS

| | | | |
|---|---|---|---|
| 2,305,124 | A | 12/1942 | Wilson, Jr. et al. |
| 2,567,586 | A | 9/1951 | Werder |
| 2,935,103 | A | 5/1960 | Landis, Jr. |
| 3,539,174 | A | 11/1970 | Borello |
| 4,527,337 | A | 7/1985 | Dreiling |
| 4,596,101 | A | 6/1986 | Brinker |
| 4,625,415 | A | 12/1986 | Diamontis |
| 4,629,171 | A | 12/1986 | Judy et al. |
| 5,031,886 | A | 7/1991 | Sosebee |
| 5,129,153 | A | 7/1992 | Burns, Sr. |
| 5,414,918 | A | 5/1995 | Pearson |
| 5,542,653 | A | 8/1996 | Maloney |
| 5,566,931 | A | 10/1996 | Considine |
| 5,628,119 | A | 5/1997 | Bingham et al. |

(Continued)

*Primary Examiner* — Jessie T Fonseca
(74) *Attorney, Agent, or Firm* — Malloy & Malloy, PL; Peter A. Matos

(57) ABSTRACT

A modular assembly jig system for use in constructing a structural element on a construction site is disposable between an operative assembled configuration and a collapsed configuration for transport or storage. The system includes a jig platform assembly comprising a plurality of platform members, and a support assembly disposed in a supporting relation to the jig platform assembly. An alignment assembly disposed along the jig platform assembly facilitates alignment of a portion of the structural element during construction. A guide assembly having at least one guide member is at least temporarily interconnected to the jig platform assembly, and an adjustable clamp assembly is operatively positionable along at least a portion of the guide assembly. The adjustable clamp assembly retains at least a portion of the structural element in position during construction. An extension assembly is provided to increase an operative working area of the jig platform assembly.

15 Claims, 9 Drawing Sheets

(56) References Cited

U.S. PATENT DOCUMENTS

| | | | |
|---|---|---|---|
| 8,448,348 | B1 | 5/2013 | Jones |
| 2002/0023402 | A1 | 2/2002 | Winchester |
| 2008/0313916 | A1 | 12/2008 | Xedis, IV |
| 2010/0199595 | A1 | 8/2010 | Morris |
| 2013/0186037 | A1 | 7/2013 | Hokanson |
| 2013/0219732 | A1 | 8/2013 | Jordan |
| 2017/0138719 | A1 | 5/2017 | Woodruff |
| 2017/0328074 | A1 | 11/2017 | Ayvazian |

MODULAR ASSEMBLY JIG SYSTEM

BACKGROUND OF THE INVENTION

Field of the Invention

The present invention relates to the field of assembly jigs and, more particularly, to an improved modular assembly jig system to increase the efficiency of construction via an on-site modular and self-supporting modular assembly jig system.

DESCRIPTION OF THE RELATED ART

Traditionally, construction practices rely on building materials which are delivered to a construction site. These practices include the delivery of raw materials (e.g., such as lumber, fasteners), construction equipment, e.g., cranes, forklifts, etc., and even prefabricated elements, e.g., walls, concrete slabs, etc. For example, flatbed trucks are often employed to deliver roofing segments or wall segments to speed up construction of a large building. Many times, prefabricated elements are assembled offsite and transported, often large distances, to the construction site. Many times elements can be large and substantially hollow which can be expensive to transport and highly inefficient (e.g., due to size). For example, a framed wall with studs can be primarily hollow due to empty space between studs and as a result require a large amount of space to transport the wall although the unassembled materials take up a substantially smaller amount of space to transport.

Further, construction of structural assemblies is traditionally performed on a horizontal plane which requires laborers to continually bend over to affix support elements during construction. Since laborers are required to continually bend over, laborer fatigue is quick to occur and can result in slowed construction times and injured workers (e.g., back injuries). Further, large structural assemblies are often dangerous for laborers to work with due to heavy equipment required to assist in the construction. For example, conventionally outer and inner walls are constructed on site after which roof beams and trusses are constructed and manipulated in place. The roof work, which includes handling horizontal subfacia, then vertical subfacia, then installing bucks, cutting overhangs for buckets, and constructing the outlookcr is all done up in the air, wherein construction workers are standing on ladders in precarious positions handling heavy objects and making manual adjustments.

SUMMARY OF THE INVENTION

As indicated above, the present invention is directed to a modular assembly jig system for use in constructing a structural element on a construction site. More in particular, the modular assembly jig system in accordance with the present invention is disposable between an operative assembled configuration and a collapsed configuration for transport or storage.

In at least one embodiment, a modular assembly jig system comprises a jig platform assembly comprising a plurality of platform members. The system also includes a support assembly disposed in a supporting relation to the jig platform assembly. More in particular, in at least one embodiment, corresponding ones of the plurality of platform members and support members securely and releasably engage one another via corresponding platform member interconnects and support member interconnects while the present modular assembly jig system is disposed in an operative assembled configuration on a construction site.

According to one embodiment of the present invention, the modular assembly jig system also comprises an alignment assembly disposed along a portion of the jig platform assembly, wherein the alignment assembly facilitates alignment of at least a portion of a structural element during construction thereof.

In at least one embodiment, a guide assembly is provided and includes at least one guide member at least temporarily interconnected to the jig platform assembly, and in at least one further embodiment, the guide assembly includes a plurality of guide members at least temporarily interconnected to the jig platform assembly. An adjustable clamp assembly having at least on clamp member is provided to retain at least a portion of the structural element in position during construction. In at least one embodiment, an adjustable clamp assembly includes a plurality of clamp members operatively disposed along the guide assembly.

An extension assembly is provided in at least one embodiment of the present modular assembly jig system, and the extension assembly is disposable to increase an operative working area of the jig platform assembly.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

As previously stated, the present invention is directed to a modular assembly jig system, generally as shown as at

1000 throughout the figures. The modular assembly jig system 1000 is structured to facilitate the construction of a plurality of structural elements directly on a construction site, thereby eliminating the time delays and transport expense associated with fabrication of structural elements off-site for subsequent transport to a construction site. Importantly, the modular assembly jig system 1000 in accordance with the present invention is disposable between an operative assembled configuration, such as is shown best in the illustrative embodiments of FIGS. 1, 2, 8 and 9, and a collapsed configuration to facilitate transport of the system 1000 to and from a construction site, as well as for storage purposes.

Figure 1:
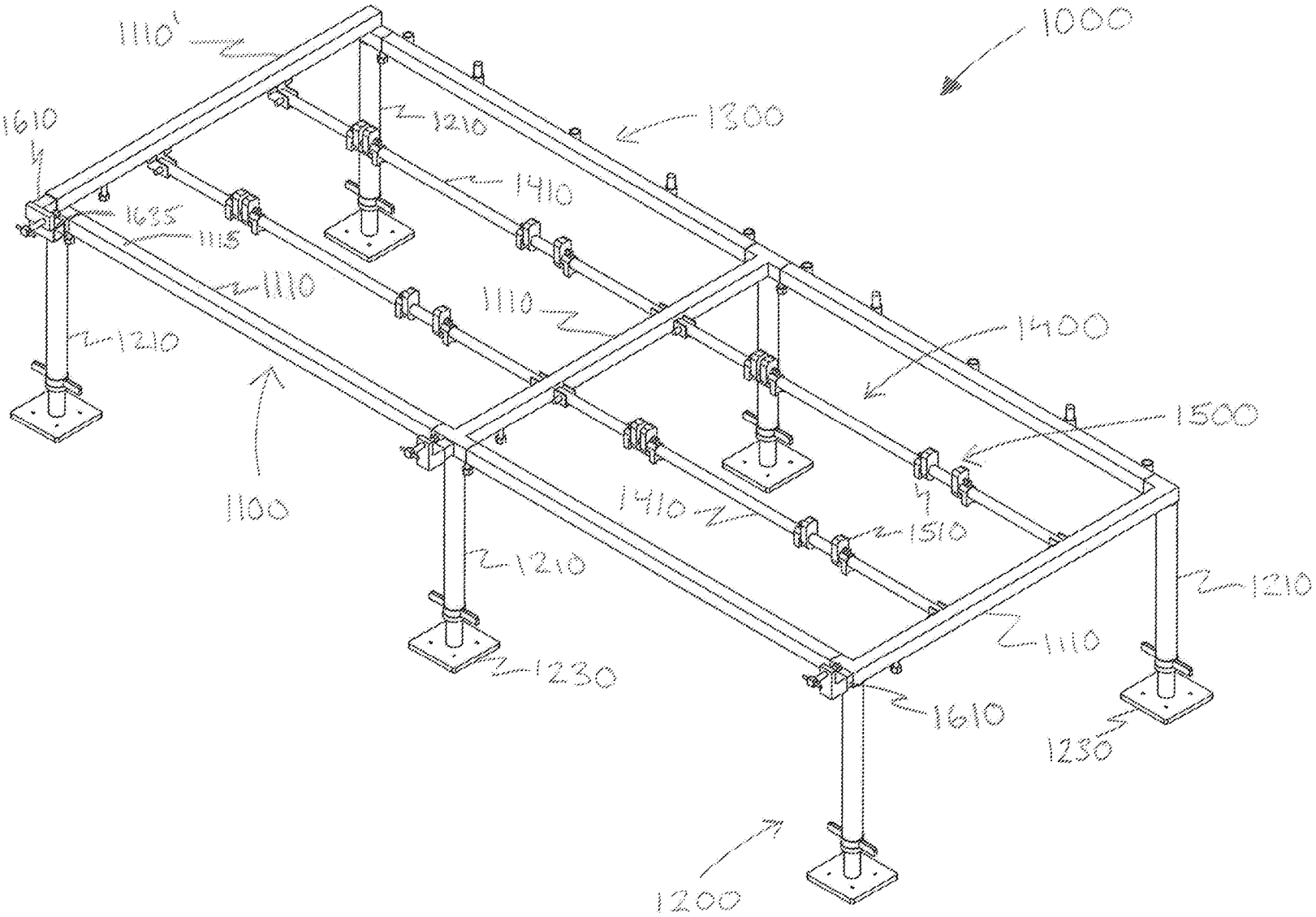
FIG. 1 is a perspective view of one illustrative embodiment of a modular assembly jig system in accordance with the present invention in a retracted configuration.

More in particular, and with reference to the illustrative embodiment of FIG. 1, the present invention is directed to a modular assembly jig system 1000. In accordance with at least one embodiment of the present invention, a modular assembly jig system 1000 comprises a jig platform assembly 1100. As may be seen from the illustrative embodiment of FIG. 1, a jig platform assembly 1100 comprises a plurality of platform members 1110. At least one of the plurality of platform members 1110 comprises an elevated platform stop member 1110', such as is shown in the illustrative embodiments of FIGS. 1 and 2. More in particular, an elevated platform stop member 1110' in accordance with the present invention is mounted atop of corresponding support members 1210, discussed in greater detail below, such that at least a portion of a structural element may be positioned in an abutting and aligned relation with the elevated platform stop member 1110' while the structural element is being fabricated on-site utilizing a modular assembly jig system 1000 in accordance with the present invention.

With continued reference to the illustrative embodiment of FIG. 1, a modular assembly jig system 1000 in accordance with the present invention further comprises a support assembly 1200. In at least one embodiment of the present invention, the support assembly 1200 is disposed in supporting relation to a jig platform assembly 1100, such as is shown best in the illustrative embodiments of FIGS. 1 and 2. A support assembly 1200 includes a plurality of support members 1210. In at least one embodiment of the present invention, at least some of the plurality of support members 1210 include a support member interconnect 1220 such as may be seen best in the exploded perspective view of a modular assembly jig system 1000 in FIG. 3. Similarly, in one further embodiment, at least some of the plurality of platform members 1110 include a platform member interconnect 1120, once again, as best seen in the illustrative embodiment of FIG. 3.

In accordance with at least one embodiment of a modular assembly jig system 1000 of the present invention, corresponding ones of the plurality of platform members 1110 and the plurality of support members 1210 releasably engage one another via a corresponding ones of the platform member interconnects 1110 and support member interconnects 1210 while the modular assembly jig system 1000 is disposed in an operative assembled configuration. As best shown in the illustrative embodiment of FIG. 3, the platform member interconnects 1110 and corresponding support member interconnects 1210 comprise a female and male socket type interconnect, respectively. As will be appreciated by those of skill in the art, any of a variety of mechanical interconnects, 1120, 1220, may be utilized within the scope and intent of the present invention provided such interconnects, 1120, 1220, permit secure and releasable interconnection of corresponding ones of the plurality of platform members 1110 and support members 1210.

In accordance with one further embodiment of a modular assembly jig system 1000 of the present invention, a plurality of releasable fasteners 1150 are utilized to securely and releasably retain corresponding ones of the plurality of platform members 1110 and support members 1210 in position with one another while the modular assembly jig system 1000 is disposed in an operative assembled configuration. In at least one embodiment, such as may be seen in the illustrative embodiment of FIG. 3, a plurality of releasable fasteners 1150 comprise a plurality of set screws. As before, it will be appreciated by those of skill in the art that any of a variety of releasable mechanical fasteners 1150 may be utilized within the scope of the and intent of the present invention, including but not limited to, cotter pins, through bolts, etc., provided, once again, that they securely and releasably retain corresponding ones of the plurality of platform members 1110 and support members 1210 in position with one another while the modular assembly jig system 1000 is disposed in an operative assembled configuration.

As will be appreciated by those of skill in the art, the grading of an active construction site is often well less then level. As such, in accordance with at least one embodiment of the present invention at least some of the plurality of support members 1210 comprises a base member 1230 mounted to a lower portion thereof. As may be seen from the illustrative embodiments of FIGS. 1 and 2, each of the plurality of support members 1210 comprises a base member 1230 mounted to a lower portion thereof.

Figure 7:
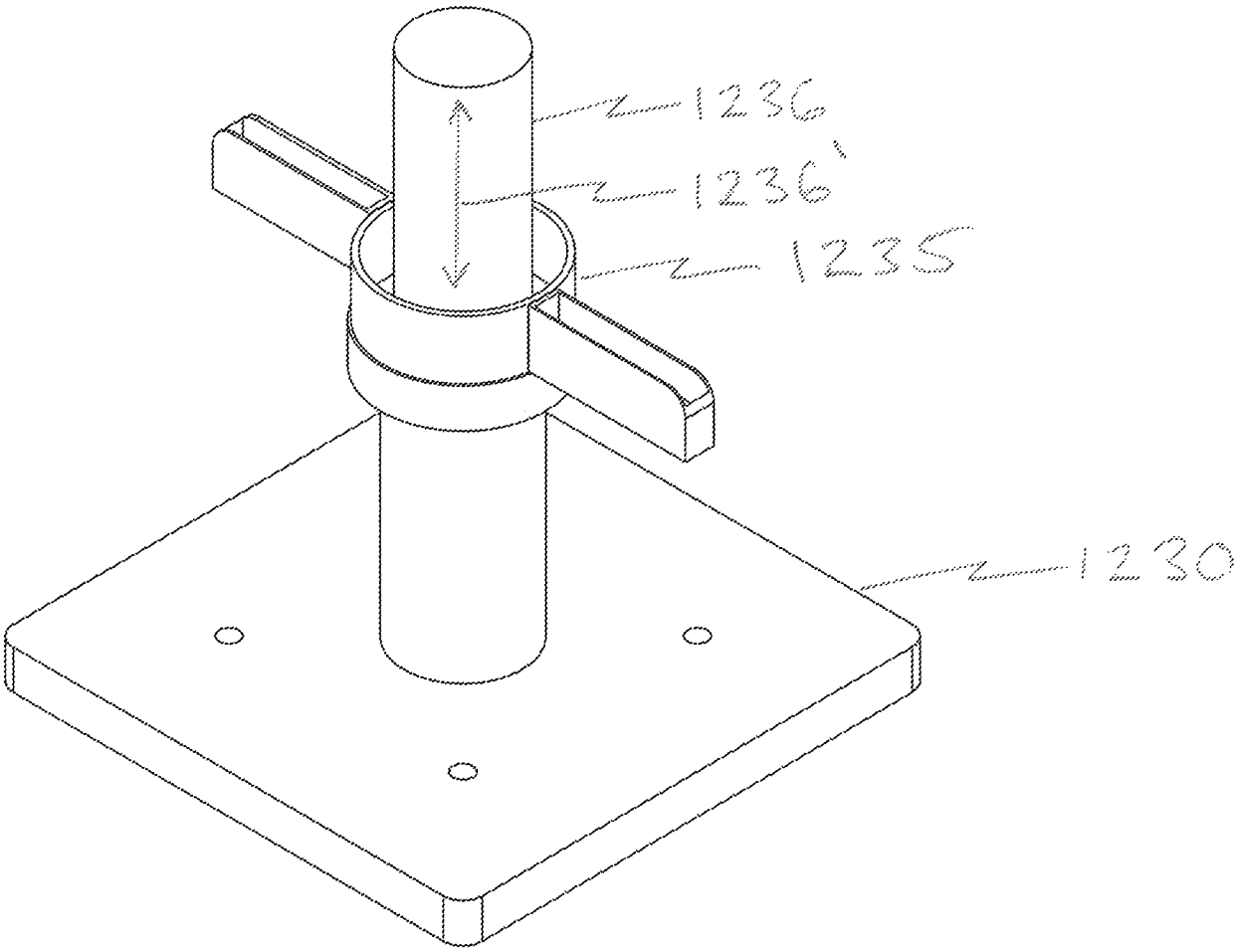
FIG. 7 is a perspective view of one illustrative embodiment of a base member of a modular assembly jig system in accordance with the present invention.

In one further embodiment, and with reference to the illustrative embodiment of FIG. 7, a base member 1230 in accordance with the present invention further comprises a base member leveling unit 1235. More particularly, a baseline member leveling unit 1235 comprises a leveling member 1236 which engages a lower portion of a corresponding support member 1210 and is movable vertically relative to base member 1230 as shown by directional arrow 1236' in the illustrative embodiment of FIG. 7. As such, the operative length of each of the plurality of support members 1210 may be independently adjusted to account for irregularities in the grade of a construction site on which the present modular assembly jig system 1000 is deployed, so as to provide a reasonably level planar surface across a jig platform assembly 1100.

Looking once again to the illustrative embodiment of FIG. 1, a modular assembly jig system 1000 in accordance with the present invention further comprises an alignment assembly 1300. In at least one embodiment, an alignments assembly 1300 is disposed along a portion of a jig platform assembly 1100. More particularly, an alignment assembly 1300 facilitates aligning at least a portion of a structural element on a jig platform assembly 1100, while the structural element is being fabricated in place on a construction site.

Figure 3:
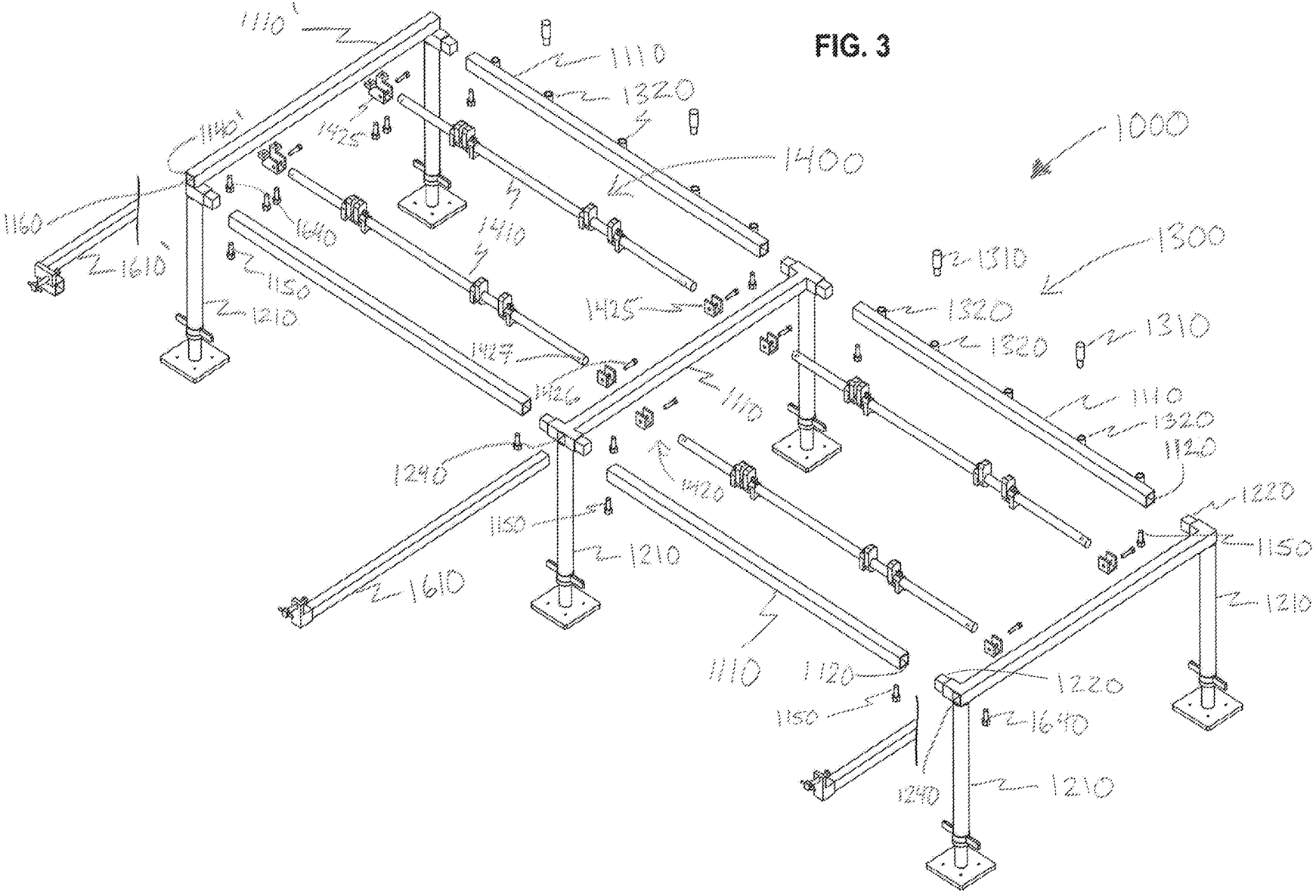
FIG. 3 is an exploded perspective view of the illustrative embodiment of the modular assembly jig system of FIG. 1.

With reference to the exploded perspective view of the illustrative embodiment of a modular assembly jig system 1000 as shown in FIG. 3, an alignment assembly 1300 comprises a plurality of alignment pins 1310. In accordance with at least one embodiment of the present invention, an alignment assembly 1300 comprises at least one alignment pin support 1320, and in one further embodiment, an alignment assembly 1300 comprises a plurality of alignment pin supports 1320. Each alignment pin support 1320 is dimensioned to receive at least a portion of one alignment pin 1310 therein, and to releasably retain the alignment pin 1310 in a supported disposition. With reference once again to the illustrative embodiment of FIG. 3, the alignment assembly 1300 comprises a plurality of alignment pin supports 1320, wherein each of the plurality of alignment pin supports 1320 is affixed at different locations along an outwardly facing surface of select ones of the plurality of platform members 1110.

As will be appreciated by those of skill in the art, each of the plurality of alignment pins 1310 is movably positionable into different ones of the plurality of alignment pin supports 1320 to facilitate positioning the plurality of alignment pins 1310 into any of a plurality of different operative arrays, such as may be required to accommodate the various structural elements which may be constructed on a construction site utilizing a modular assembly jig system 1000 in accordance with the present invention.

A modular assembly jig system 1000 in accordance with at least one embodiment of the present invention further comprises a guide assembly 1400 such as is shown in the illustrative embodiment of FIG. 1. In at least one embodiment, a guide assembly 1400 comprises at least one guide member 1410. As shown in FIG. 1, in one further embodiment, a guide assembly 1400 comprises a plurality of guide members 1410. As also shown in the illustrative embodiment of FIG. 1, the plurality of guide members 1410 are at least temporarily interconnected to the jig platform assembly 1100.

Looking to the illustrative embodiment of FIG. 3, a guide assembly 1400 in accordance with the present invention comprises a plurality of guide members 1410 with are releasably interconnected at opposite ends to different ones of the plurality of platform members 1110, 1110' via a different one of a plurality of guide supports 1420. As shown in the illustrative embodiment of FIG. 3, each guide support 1420 comprise a bracket 1425 secured along the length of one of the plurality of platform members 1110, 1110'. Further, each guide member 1410 includes a guide member interconnect 1427 disposed at opposite ends to facilitate interconnection of the guide member 1410 to a corresponding bracket 1425. As shown in the illustrative embodiment of FIG. 3, the guide member interconnect 1427 comprises a hole or channel extending through each opposite end of the guide members 1410 such that a fastener 1426 may be inserted into and through the guide member interconnect 1427 and the corresponding apertures in the bracket 1425, thereby releasably interconnecting the guide members 1410 to the platform members 1111, 1110' which form the platform assembly 1100.

Once again, it will be appreciated by those of skill in the art that a variety of combinations of guide support 1420 and guide member interconnect 1427 may be utilized within the scope of the and intent of the present invention, including but not limited to, cotter pins, through bolts, etc., provided that they releasably interconnect the plurality of guide members 1410 in position with one corresponding ones of the platform members 1110, 1110', while the modular assembly jig system 1000 is disposed in an operative assembled configuration.

Returning to the illustrative embodiment of FIG. 1, a modular assembly jig system 1000, in accordance with at least one embodiment of the present invention, further comprises an adjustable clamp assembly 1500. An adjustable clamp assembly 1500 in accordance with the present invention retains at least a portion of a structural element in position on a jig platform assembly 1100, once again, while the structural element is being fabricated in place on the construction site. An adjustable clamp assembly 1500 includes at least one clamp member 1510. As shown in the illustrative embodiment of FIG. 1, an adjustable clamp assembly 1500 comprises a plurality of clamp members 1510. As further shown in FIG. 1, in at least one embodiment, an adjustable clamp assembly 1500 in accordance with the present invention is operable with a guide assembly 1400.

Figure 6A:
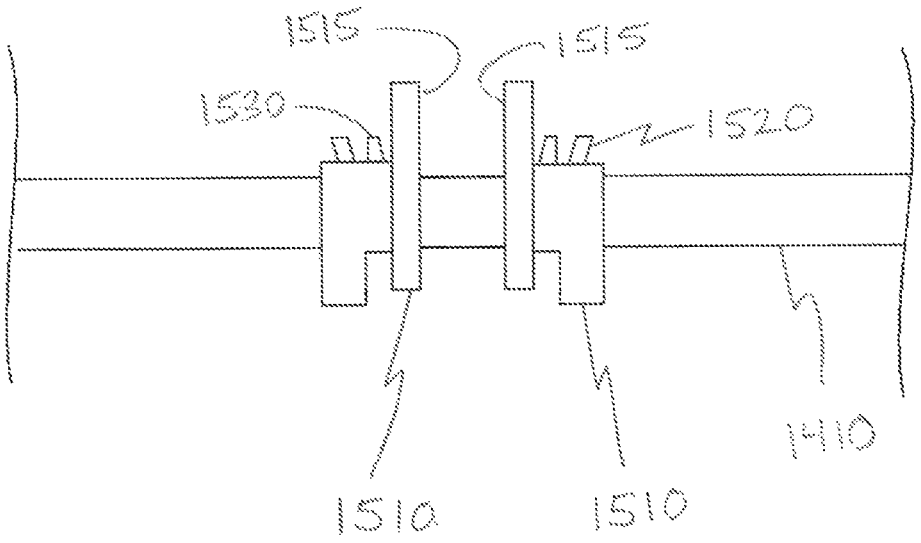
FIGS. 6A and 6B are elevations of one illustrative embodiment of an adjustable clamp assembly of a modular assembly jig system in accordance with the present invention disposed in alternate operative orientations.
Figure 6B:
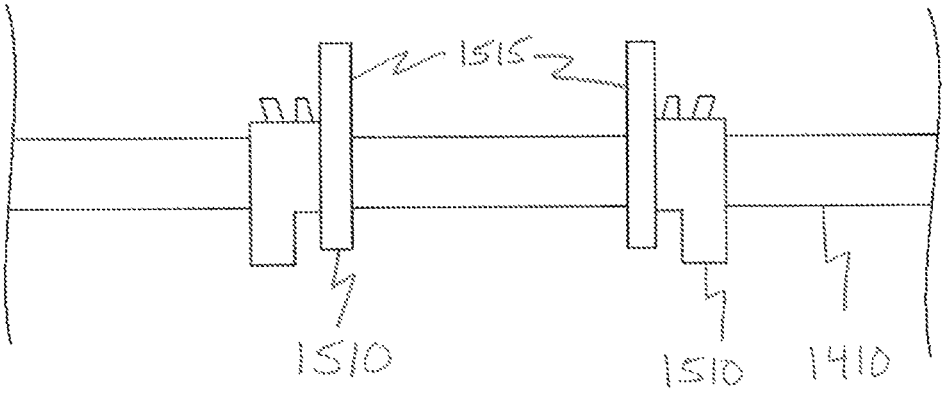

More particularly, and with reference to the illustrative embodiments of FIGS. 6A and 6B, a plurality of clamp members 1510 are operatively positionable along a guide member 1410. With reference to the illustrative embodiment of FIG. 6A, each clamp member 1510 includes a stop mechanism 1520. A stop mechanism 1520 in accordance with the present invention at least temporarily retains a corresponding clamp member 1510 in any of a plurality of operative positions along a guide member 1410 on which the clamp member 1510 is operable. Further, each clamp member 1510 comprises a release 1530. A release 1530 in accordance with the present invention at least temporarily allows a corresponding clamp member 1510 to be moved from one of the plurality of operative positions to another of the plurality of operative positions along a guide member 1410 on which the clamp member 1510 is operable.

With further reference to the illustrative embodiments of FIGS. 6A and 6B, a plurality of clamp members 1510 are shown in two different operative positions along guide member 1410. First, with reference to FIG. 6A, the plurality of clamp members 1510 are operatively positioned along guide member 1410 such that the corresponding clamp faces 1515 of the clamp members 1510 are disposed in close proximity to one another. With reference to FIG. 6B, the plurality of clamp members 1510 are operatively positioned along guide member 1410 such that the corresponding clamp faces 1515 of the clamp members 1510 are disposed well apart from one another relative to the operative position of the clamp members 1510 as shown in FIG. 6A. As will be appreciated by those of skill in the art, an adjustable clamp assembly 1500 in accordance with the present invention facilitates retention of any of a number of structural components of a structural element in position on a jig platform assembly 1100 while the structural element is being fabricated in place on the construction site.

Figure 2:
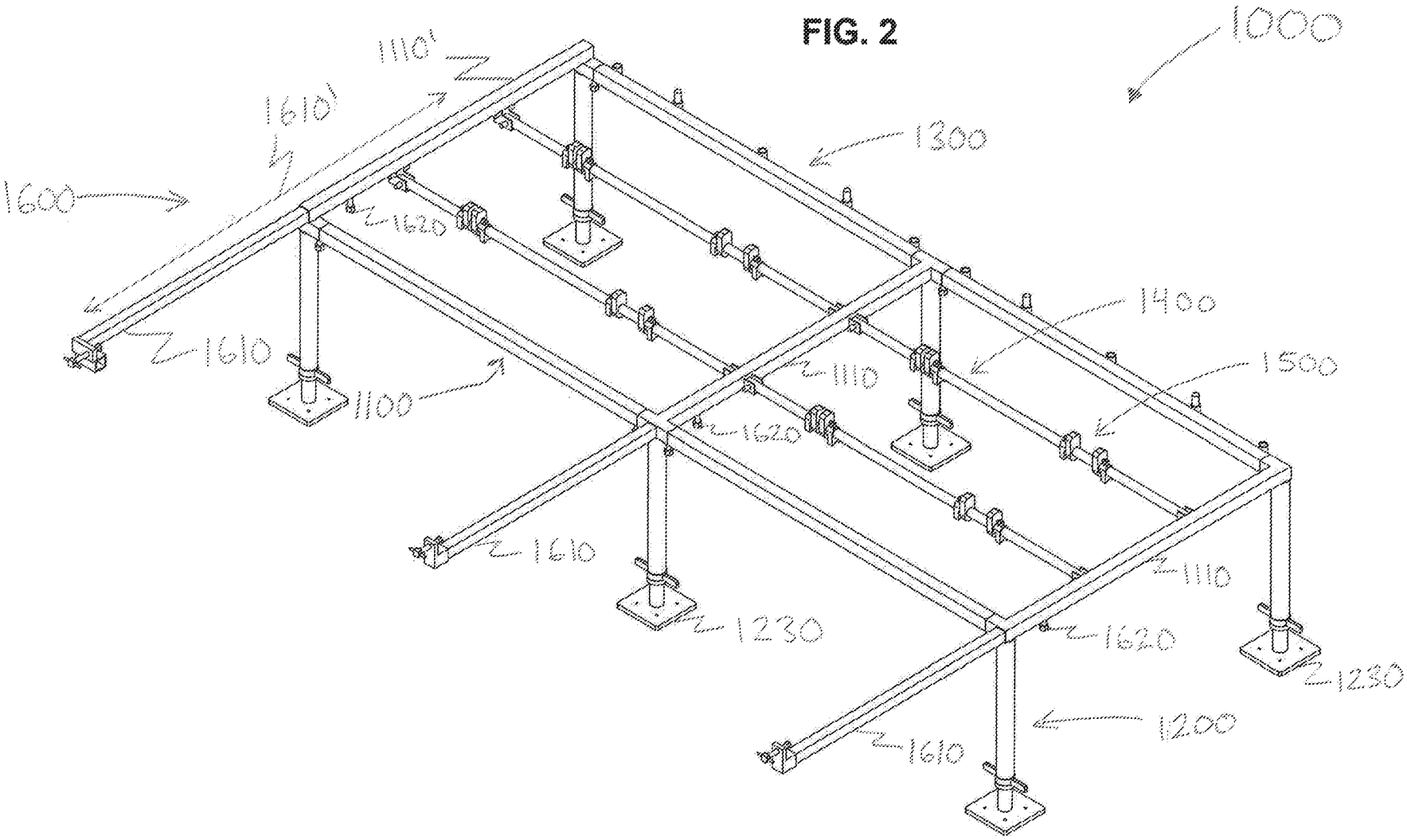
FIG. 2 is a perspective view of the illustrative embodiment of the modular assembly jig system of FIG. 1 in an extended configuration.

Turning next to the illustrative embodiment of FIG. 2, a modular assembly jig system 1000 in accordance with the present invention is shown. As before, the modular assembly jig system 1000 comprises a jig platform assembly 1100 and the support assembly 1200 disposed in a supporting relation to the jig platform assembly 1100. The modular assembly jig system 1000 as shown in the illustrative embodiment of FIG. 2 further includes an alignment assembly 1300. Similar to the illustrative embodiments of a modular assembly jig system 1000 as shown in FIG. 1, the modular assembly jig system 1000 shown in FIG. 2 comprises a guide assembly 1400 and an adjustable clamp assembly 1500 operative therewith.

With continued reference to the illustrative embodiment of FIG. 2, a modular assembly jig system 1000 in accordance with the present invention further comprises an extension assembly 1600. An extension assembly 1600 in accordance with at least one embodiment of the present invention includes at least one extension member 1610. In accordance with the illustrative embodiment of FIG. 2, an extension assembly 1600 comprises a plurality of extension members 1610, 1610'. With continued reference to the illustrative embodiment of FIG. 2, each of the plurality of extension members 1610, 1610' is disposed in a fully extended configuration. More in particular, each of the plurality of extension members 1610 is movable along a portion of a different corresponding one of the plurality of platform member's 1110, 1110', such as is shown, by way of example, by directional arrow 1610', between a fully extended configuration, as seen in the illustrative embodiment of FIG. 2, and a retracted configuration as in FIG. 1. With reference again to the illustrative embodiment of FIG. 3, one or more of support member 1210 comprises an extension member aperture 1240 dimensioned to permit at least one end of an extension member 1610 to pass there through and into and along an extension channel 1160 disposed through a corresponding one of the plurality of platform members 1110. With continued reference to FIG. 3, elevated platform stop member 1110' comprises an extension member aperture 1140' at one end dimensioned to permit one end of extension member 1610' to pass there through and into and along extension channel 1160. As will be appreciated by those of skill in the art, while one or more of the plurality of extension members 1610 of an extensions assembly 1600 are disposed in an extended configuration, the extension assembly 1600 serves to increase an operative working area of a jig platform assembly 1100 in accordance with the present invention.

Figure 4:
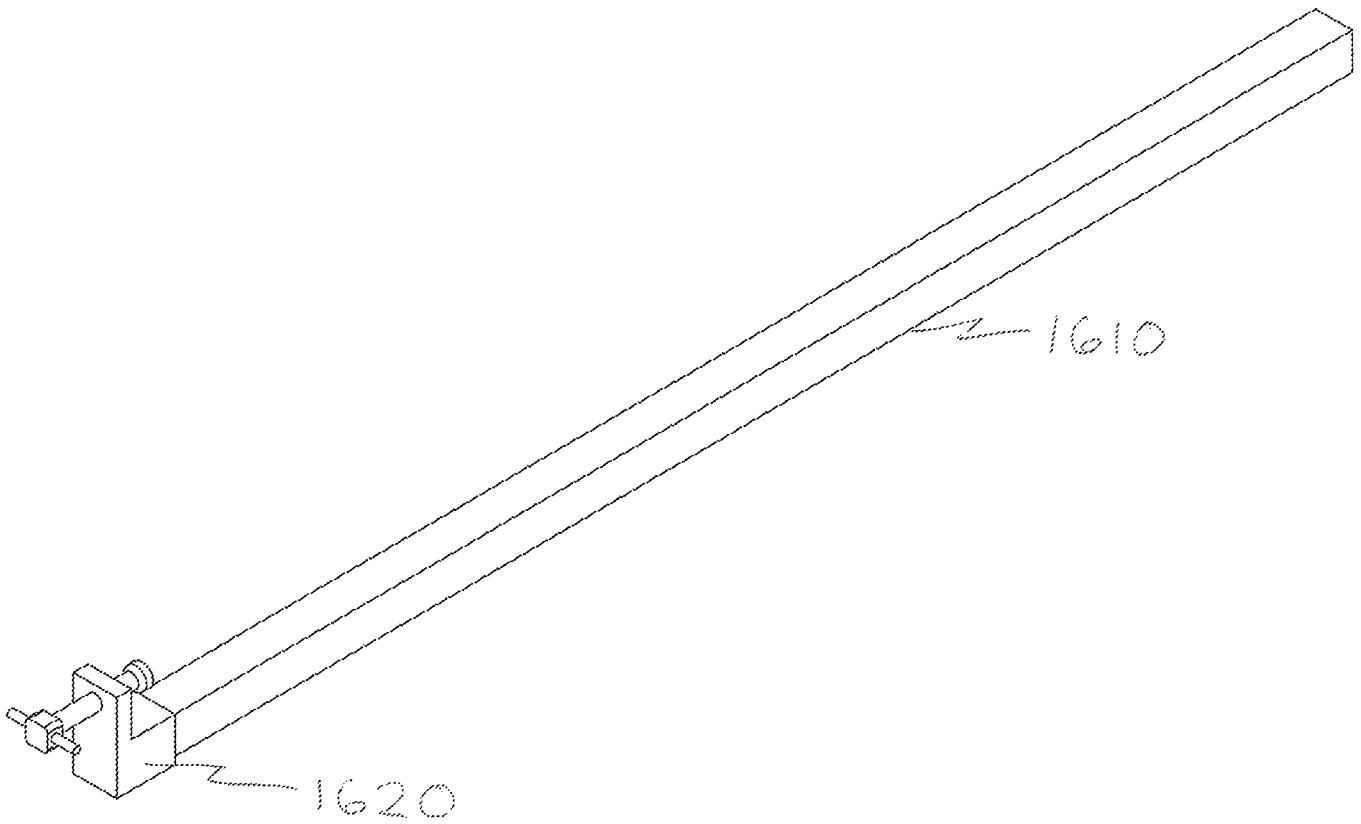
FIG. 4 is a perspective view of one illustrative embodiment of an extension member of a modular assembly jig system in accordance with the present invention.

FIG. 4 is a perspective view of one illustrative embodiment of an extension member 1610 of a modular assembly jig system 1600 in accordance with the present invention. As may be seen from the illustrative embodiment of FIG. 4, an extension member 1610 in accordance with one embodiment of the present invention comprises an elongated configuration. As further shown in FIG. 4, extension member 1610 has an extension clamp member 1620 affixed to one end thereof.

Figure 5:
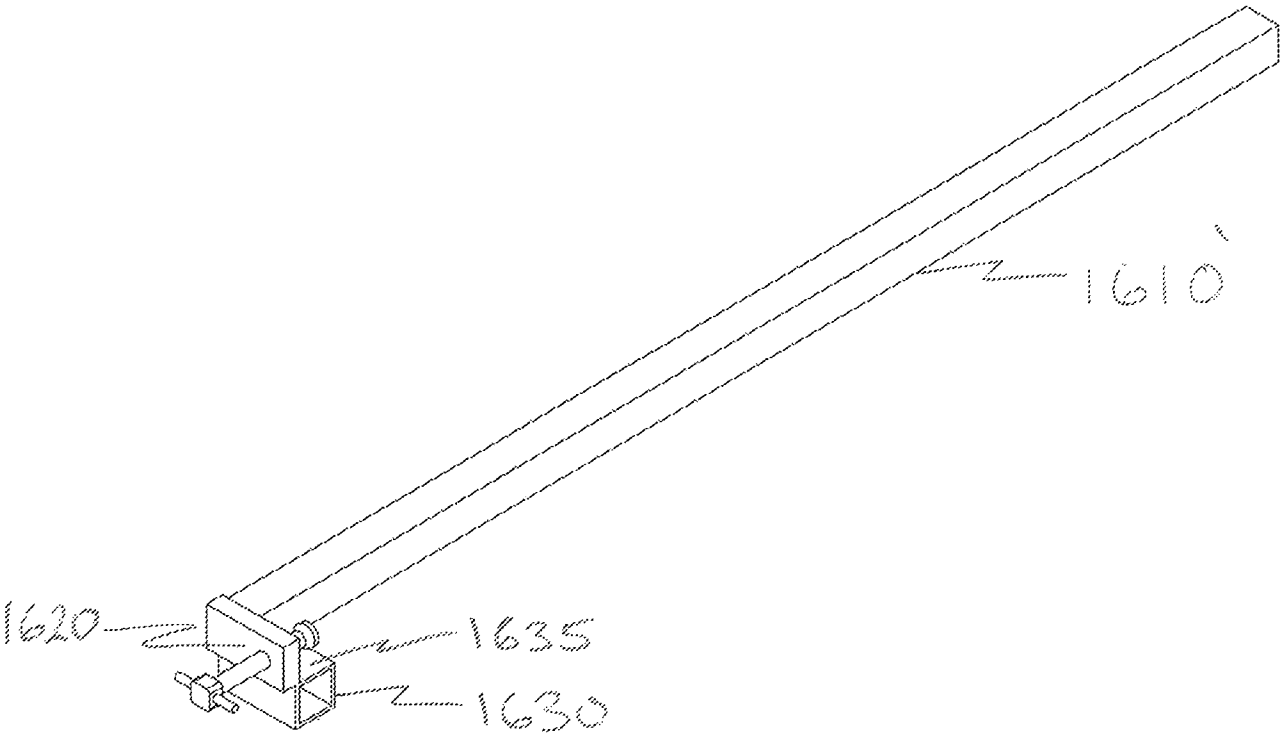
FIG. 5 is a perspective view of an alternative illustrative embodiment of an extension member of a modular assembly jig system in accordance with the present invention.

Looking next to the illustrative embodiment of FIG. 5, a perspective view of an alternative embodiment of an extension member 1610' of a modular assembly jig system 1600 in accordance with the present invention is presented. As before, extension members 1610' comprises an elongated configuration, and has an extension clamp member 1620 affixed to one end thereof. As further shown in the illustrative embodiment of FIG. 5, an extension adjustment member 1630 is affixed to the same end of extension member 1610' as extension clamp member 1620. More in particular, an extension adjustment member 1630 is affixed at one end to the underside of an extension member 1610' such that a top surface 1635 of extension adjustment member is 1630 is coplanar with a top surface 1115 of the plurality of platform members 1110, as may be seen in FIG. 1.

Figure 8:
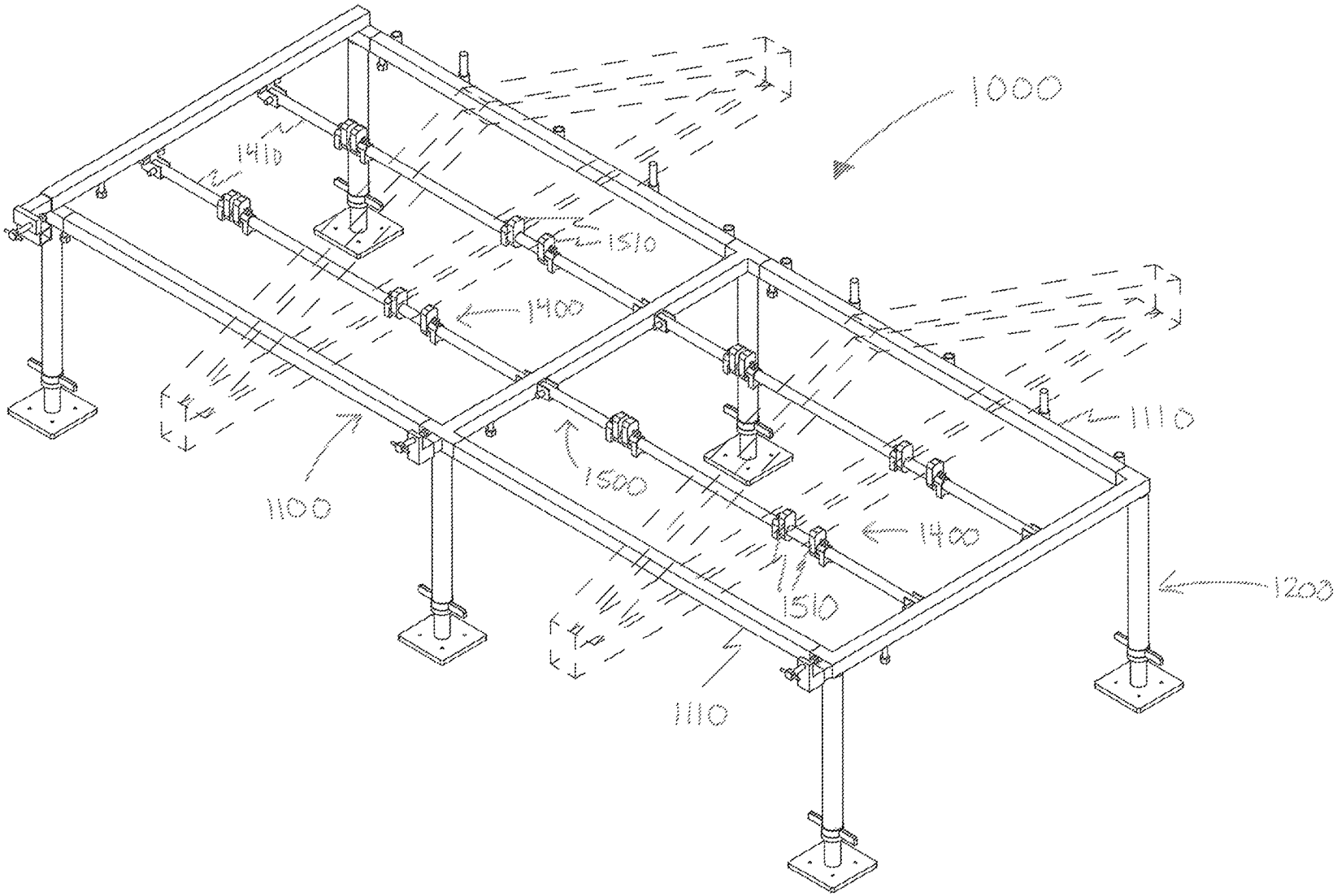
FIG. 8 is a perspective view of the illustrative embodiment of the modular assembly jig system of FIG. 1 supporting a one structural element thereupon.

Turning next to the illustrative embodiment of FIG. 8, a perspective view of one embodiment of a modular assembly jig system 1000 supporting a portion of one structural element thereupon is presented. As before, the modular assembly jig system 1000 comprises a jig platform assembly 1100 upon which a pair of roof trusses are constructed, as shown in the illustrative embodiment of FIG. 8. Also as before, a support assembly 1200 is disposed in supporting relation to the jig platform assembly 1100. An adjustable clamp assembly 1500 comprising a plurality of clamp members 1510 which are operatively positioned along corresponding ones of the plurality of guide members 1410. More particular, and as shown in the illustrative embodiment of FIG. 8, each roof truss element is retained in position by corresponding pairs of clamp members 1510, and as further shown in FIG. 8, portions of each roof truss are further supported by corresponding ones of the plurality of platform members 1110.

Figure 9:
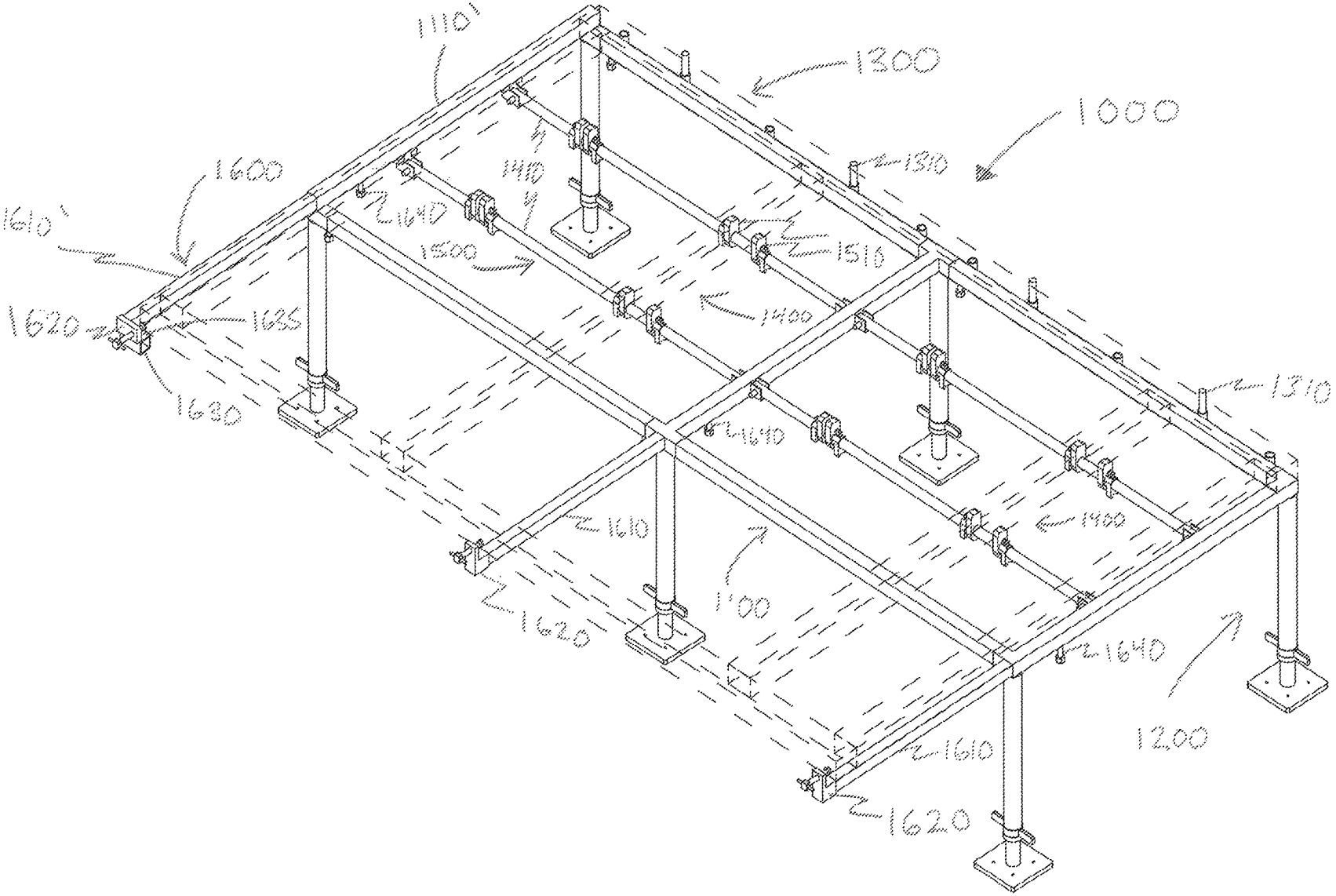
FIG. 9 is a perspective view of the illustrative embodiment of modular assembly jig system of FIG. 1 supporting a different structural element thereupon.

Looking finally to the illustrative embodiment of FIG. 9, a perspective view of one embodiment of a modular assembly jig system 1000 supporting another structural element thereupon is presented. As before, the modular assembly jig system 1000 comprises a jig platform assembly 1100 upon which a wall frame assembly is constructed. As further shown in the illustrative embodiment of FIG. 9, an extension assembly 1600 is disposed in an extended configuration so as to substantially increase the operative working area of the jig platform assembly 1100. With further reference to FIG. 9, each of the plurality of extension members 1610, 1610' are extended outwardly from the jig platform assembly 1100 in a supporting relation to at least a portion of the wall frame being constructed. Corresponding extension fasteners 1640 are utilized to retain each extension member 1610, 1610' in the extended configuration while the all frame is being constructed. Furthermore, extension clamp members 1620 are utilized to releasably retain at least a portion of the wall frame assembly in positon while being constructed on a modular assembly jig system 1000 in accordance with the present invention.

Also as before, a support assembly 1200 is disposed in supporting relation to the jig platform assembly 1100. An adjustable clamp assembly 1500 comprising a plurality of clamp members 1510 which are operatively positioned along corresponding ones of the plurality of guide members 1410. More particularly, and as shown in the illustrative embodiment of FIG. 9, different components of the wall frame assembly are retained in position by corresponding pairs of clamp members 1510, and as further shown in FIG. 9, portions of different components of the wall frame assembly are further supported by corresponding ones of the plurality of platform members 1110 and extension members 160, 1610' . With further reference to the illustrative embodiment of FIG. 9, a portion of the wall frame assembly being constructed is maintained in an aligned orientation by abutting against the plurality of alignment pins 1310 of alignment assembly 1300. As further shown in FIG. 9, another portion of the wall frame assembly is maintained in position by abutting against an inner fact of elevated platform stop member 1110'.

As will be appreciated by those of skill in the art, the combination of the plurality of alignment pins 1310 of alignment assembly 1300, the elevated platform stop member 1110', and the clamp members 1510 of the adjustable clamp assembly 1500 serve to facilitate squarely positioning at least a portion of a construction element being constructed on a modular assembly jig system 1000 in accordance with the present invention.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A modular assembly jig system for use in constructing a structural element on a construction site, said system comprising:

a jig platform assembly comprising a plurality of platform members, a support assembly disposed in a supporting relation to said jig platform assembly, an alignment assembly disposed along a portion of said jig platform assembly, said alignment assembly facilitates alignment of at least a portion of the structural element during construction thereof, a guide assembly having at least one guide member at least temporarily interconnected to said jig platform assembly, an adjustable clamp assembly retains at least a portion of the structural element in position during construction, and said modular assembly jig system disposable between an operative assembled configuration and a collapsed configuration for transport or storage, said support assembly comprising a plurality of support members, each of said plurality of support members comprising at least one support member interconnect, at least some of said plurality of platform members comprise at least one platform member interconnect, and corresponding ones of said plurality of platform members and said plurality of support members securely and releasably engage one another via corresponding ones of said platform member interconnects and said support member interconnects while said modular assembly jig system is disposed in said operative assembled configuration.

2. The system as recited in claim 1 further comprising a plurality of releasable fasteners, wherein said corresponding ones of said plurality of platform members and said corresponding ones of said plurality of support members are securely and releasably retained in position with one another via at least one of said plurality of releasable fasteners while said modular assembly jig system is disposed in said operative assembled configuration.

3. The system as recited in claim 1 wherein said adjustable clamp assembly comprises at least one clamp member operatively positionable along said at least one guide member.

4. The system as recited in claim 3 wherein said at least one clamp member is structured to be retained in any of plurality of operative positions along said at least one guide member, and said at least one clamp member further comprises a release to at least temporarily allow said at least one clamp member to be moved from one of said plurality of operative positions to another of said plurality of operative positions.

5. The system as recited in claim 1 wherein said guide assembly comprises a plurality of guide members at least temporarily interconnected to said jig platform assembly.

6. The system as recited in claim 5 wherein said adjustable clamp assembly comprises a plurality of clamp members, each of said plurality of guide members having at least one clamp member operatively positionable there along.

7. The system as recited in claim 6 wherein at least one of said plurality of guide members comprise a plurality of clamp members operatively positionable there along.

8. The system as recited in claim 7 wherein each of said plurality of clamp members is structured to be retained in any of a plurality of operative positions along a corresponding one of said plurality of guide members, and said clamp member further comprises a release to at least temporarily allow said clamp member to be moved from one of said plurality of operative positions to another of said plurality of operative positions along a corresponding one of said plurality of guide members.

9. A modular assembly jig system for use in constructing a structural element on a construction site, said system comprising:

a jig platform assembly comprising a plurality of platform members, a support assembly disposed in a supporting relation to said jig platform assembly, an alignment assembly disposed along a portion of said jig platform assembly, said alignment assembly facilitates alignment of at least a portion of the structural element during construction thereof, a guide assembly having at least one guide member at least temporarily interconnected to said jig platform assembly, an adjustable clamp assembly retains at least a portion of the structural element in position during construction, an extension assembly disposable to increase an operative working area of said jig platform assembly and said modular assembly jig system disposable between an operative assembled configuration and a collapsed configuration for transport or storage, and said extension assembly comprising at least one extension member, said at least one extension member being movable along at least a portion of a length of one of said plurality of platform members.

10. The system as recited in claim 9 wherein said extension assembly comprises a plurality of extension members, each of said plurality of extension members being movable between an extended configuration and a retracted configuration along at least a portion of a different one of said plurality of platform members.

11. The system as recited in claim 10 wherein said extension assembly comprises at least one extension adjustment member corresponding to each of said plurality of extension members, each said extension adjustment member cooperatively engaging said corresponding one of said plurality of extension members to retain said extension member in either said extended configuration or said retracted configuration.

12. The system as recited in claim 10 wherein at least one said plurality of support members comprises an extension member aperture dimensioned to permit one end of one of said plurality of extension members to pass there through and into a portion of a corresponding one of said plurality of platform members interconnected thereto.

13. A modular assembly jig system for use in constructing a plurality of structural elements on a construction site, said system comprising:

a jig platform assembly comprising a plurality of platform members, a support assembly comprising a plurality of support members collectively disposed in a supporting relation to said jig platform assembly, an alignment assembly disposed along a portion of said jig platform assembly, said alignment assembly facilitates alignment of at least a portion of the structural element during construction thereof, a guide assembly having at least one guide member at least temporarily interconnected to said jig platform assembly, and an adjustable clamp assembly operable with said guide assembly retains at least a portion of at least one of the plurality structural elements in position during construction, an extension assembly disposable to increase an operative working area of said jig platform assembly, and said modular assembly jig system disposable between an operative assembled configuration and a collapsed configuration for transport or storage, and said alignment assembly comprising a plurality of alignment pins disposed along said portion of said jig platform assembly in at least one operative array.

14. The system as recited in claim 13 wherein said adjustment assembly further comprises a plurality of alignment pin supports mounted along said portion of said jig platform assembly.

15. The system as recited in claim 14 wherein each of said plurality of alignment pins is movably positionable into different ones of said plurality of alignment pin supports to facilitate positioning said plurality of alignment pins into each of a plurality of operative arrays.

* * * * *